United States Patent [19]

Hatsuno et al.

[11] 4,317,355

[45] Mar. 2, 1982

[54] FORGING OF A CAMSHAFT

[75] Inventors: Hiroshi Hatsuno, Higashi-Matsuyama; Yoshimaro Okada, Yokyo, both of Japan

[73] Assignee: Diesel Kiki Co., Ltd., Tokyo, Japan

[21] Appl. No.: 130,454

[22] Filed: Mar. 14, 1980

[30] Foreign Application Priority Data

Mar. 19, 1979 [JP] Japan ..... 54-32052

[51] Int. Cl.[3] ..... B21D 37/16; B21K 1/08

[52] U.S. Cl. ..... 72/342; 72/364; 72/377; 29/6

[58] Field of Search ..... 72/342, 364, 377, 353, 72/357, 360; 29/6

[56] References Cited

U.S. PATENT DOCUMENTS 1,668,442 5/1928 Wineman ..... 72/342 X
4,069,730 6/1978 Martin ..... 72/377

FOREIGN PATENT DOCUMENTS 153708 2/1951 Australia ..... 72/342
269686 4/1970 U.S.S.R. ..... 72/364

*Primary Examiner*—Nicholas P. Godici
*Attorney, Agent, or Firm*—Frishauf, Holtz, Goodman & Woodward

[57] ABSTRACT

Forging of a camshaft which is formed integrally with plane cams arranged longitudinally thereof. A blank for the camshaft has its cam-forming portion heated to different temperatures with the heating temperature decreasing from the axially central position towards the opposite ends. Pressure is applied to the preheated blank at the opposite ends to thereby form cams on the cam-forming portion of the blank in sequence, starting first with the axially central position of the cam-forming portion towards the opposite ends. The camshaft forged using this method has a forged fibre flow with no substantial breaks and has sufficiently high mechanical strength.

8 Claims, 13 Drawing Figures

FORGING OF A CAMSHAFT

FIELD OF THE INVENTION

This invention relates to the manufacture of metallic products having definite forms and made of steel or other metal, and particularly to the forging of steel bars or steel wires into camshafts each formed integrally with a plurality of plane cams longitudinally arranged thereon.

DESCRIPTION OF THE PRIOR ART

Conventionally, the hot forging method was used in the manufacture of camshafts, which comprises melting a material by heating, compressing the melted material in a die to form a roughly formed piece, cutting the roughly formed piece, quenching and tempering the cut piece and subjecting the thermally treated piece to a finishing treatment to obtain a camshaft. In recent years, in place of this hot forging method a cold forging method and a warm forging method have become employed in working metal blanks into mechanical parts of various configurations, which can provide a final product in a simpler and more prompt manner merely by compressing a blank for the product placed in a die to be plastically deformed, with no substantial need for the deformed material to be cut.

According to the conventional cold forging method, a blank for a camshaft is axially compressed in a forging die so that cams are formed in sequence, first, at portions near the ends, and then, at inner and central portions. However, at the time of formation of the inner or central cams, the forged fibre flow formed in the blank is often broken at the outer cam-formed portions of the blank, which makes the outer cam-formed portions fragile. As a consequence, the resulting camshaft has very low mechanical strength and is not suitable for actual use.

OBJECT AND SUMMARY OF THE INVENTION

It is therefore the object of the invention to provide a forging method for manufacturing camshafts, which enables a plurality of cams to be formed on a camshaft blank in a longitudinal arrangement in a predetermined sequence to thereby provide a camshaft which has a breakless forged fibre flow and accordingly has high mechanical strength.

According to the invention, there is provided a forging method for manufacturing camshafts having a plurality of plane cams integrally formed thereon in a longitudinal arrangement, which comprises: heating an elongated blank of an metal or an alloy to a plurality of different temperatures, wherein the blank has a cam-forming portion thereof heated to the different temperatures in a manner decreasing in heating temperature from an axially central position thereof towards opposite ends thereof; positioning the blank thus heated into a forging die; and applying pressure to the blank at opposite ends thereof in a heated state in the forging die to cause the same to be axially compressed. Cams are thereby formed on the cam-forming portion of the blank in sequence, starting first with the axially central position of the cam-forming portion towards the opposite ends. There is also provided a camshaft manufactured by the above-mentioned method of the invention.

The above and other objects, features and advantages of the invention will become more apparent upon a reading of the ensuing detailed description and accompanying drawings.

DETAILED DESCRIPTION

Figure 2:
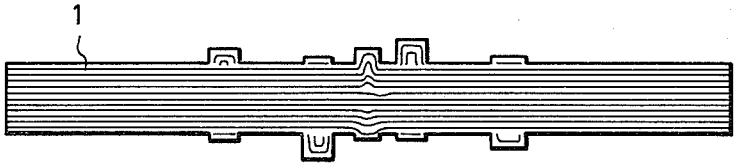
FIG. 2 is a view showing the forged fibre flow of a camshaft obtained by the conventional forging method.
Figure 3:
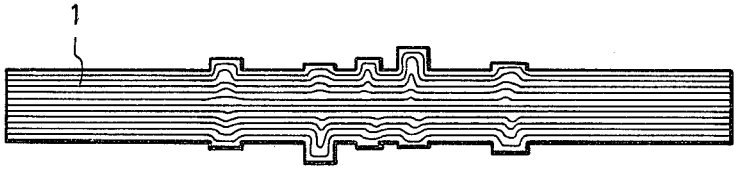
FIG. 3 is a view showing a preferred forged fibre flow for a camshaft.

In manufacturing a camshaft by the conventional cold forging method, a blank for the camshaft is compressed by applying axial force to the blank at its opposite ends. Cams are formed first near the opposite ends of the blank and then at the inner portions. Consequently, there may occur breaks in the resulting forged fibre flow formed in the blank at the outer cam-formed portions, as shown in FIG. 2. Under the worst possible conditions, there may occur cracks in the roots of the outer cams, which results in the outer cam-formed portions of the blank being fragile, with low mechanical strength, and therefore, is not suitable for use as a camshaft. The preferred forged fibre flow is shown in FIG. 3. In order to obtain a camshaft with a breakless forged fibre flow, it is necessary to forge a camshaft blank in such a manner that a central cam is first formed and then cams are formed at opposite adjacent sides of the central cam, followed by formation of further cams on the outer or end portions of the blank.

Therefore, according to the present invention, in order to realize the formation of cams in the above-mentioned sequence, a portion of the blank where the central cam is to be formed is heated to a predetermined temperature and portions of the blank at opposite adjacent sides of the central cam-forming portion where the outer cams are to be formed are heated to lower temperatures than the firstmentioned central cam-forming portion temperature. In this manner, the blank is heated with its maximum temperature at the center portion decreasing toward the opposite ends so as to cause formation of cams at preselected portions of the blank in a predetermined sequence. The resulting camshaft has a forged fibre flow extending therein without a break and therefore is sufficient in mechanical strength.

Those metals which are soft and low in deformation resistance as well as in thermal conductivity are suitable for use as blanks for the method of the invention. In this respect, steel is particularly preferable. However, even non-ferrous metals may also be used insofar as they have sufficiently low thermal conductivity and fulfill other forging requirements.

Figure 1:
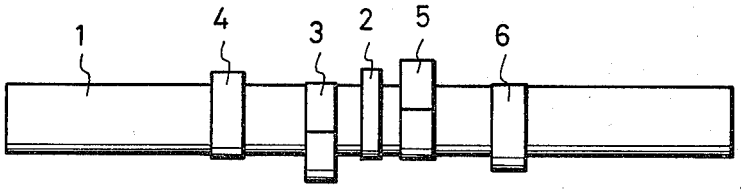
FIG. 1 is a front view of a camshaft which can be manufactured by the method of the present invention.

An embodiment of the invention will now be described. FIG. 1 shows a camshaft 1 which is adapted for use in fuel injection pumps and which can be manufactured by the method of the invention. This camshaft 1 is in a semi-finished state and will be subjected to finishing for tapering and toothing the opposite end portions for mounting in an fuel injection pump, not shown, and for engagement with associated shafts, not shown, respectively. More specifically, the illustrated camshaft 1 is intended for particular use in an in-line type fuel injection pump, not shown, for four-cylinder internal combustion engines It is seen in FIG. 1 that a plane cam 2 is formed on the axially central portion of the camshaft 1, and plane cams 3, 4 and 5, 6 are formed at the opposite adjacent sides of the central cam 2. The cams 3, 4, 5 and 6 are adapted for engagement with the pumping plungers of an associated fuel injection pump, not shown, a tappet and other coupling elements to drive the plungers, while the central cam 2 is adapted for engagement with the pumping piston of a fuel feed pump mounted on the associated fuel injection pump to drive the piston.

Figure 4:
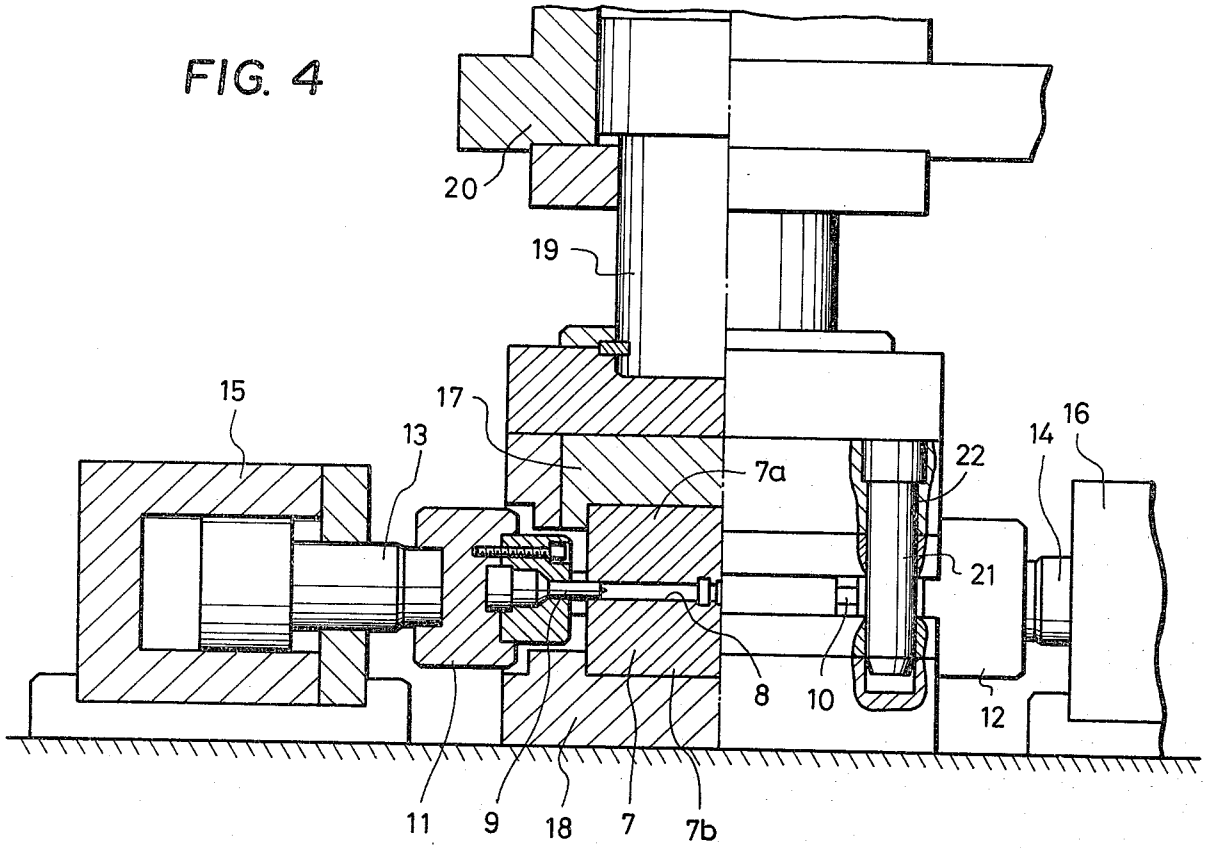
FIG. 4 is a front view of a forging machine which is adapted for use in carrying out the method of the invention, with the right half portion in section.

Such camshaft 1 can be manufactured by a forging machine as shown in FIG. 4 for instance. Reference numeral 7 designates a die consisting of an upper die *7a* and a lower die *7b*. A horizontally elongated cavity 8 is defined between the upper die *7a* and the lower die *7b*. The upper and lower dies *7a*, *7b* are previously heated to temperatures within a range of 90°–220° C. A blank in the form of a wire or a bar, not shown, is positioned into the cavity 8 of the hot die 7 and has its opposite ends pressed by punches 9, 10 under a maximum pressure of 200 tons (250 kg/cm$^2$).

The punches 9, 10 are coupled to piston rods 13, 14 via coupling members 11, 12 and are actuated by hydraulic cylinders 15, 16 through the piston rods 13, 14. The upper die *7a* and the lower die *7b* of the die 7 are held together by an upper die holder 17 and a lower die holder 18. The die 7 is pressed in the vertical direction under a maximum pressure of 500 tons (250 kg/cm$^2$) by a hydraulic cylinder 20 which is located above the die 7, through a piston rod 19. Reference numeral 21 designates a guide rod for the piston rod, and 22 a guide bore for the guide rod 21.

The manner of forming a camshaft such as the one shown in FIG. 1 in accordance with the method of the invention will now be described. First, a steel material in the form of a wire or a bar is cut into elongated blanks, each having a suitable predetermined length. The blanks are heated in an induction furnace, particularly in a high-frequency heater or by other like means. In the manufacture of camshafts according to the invention, this heating step is of prime importance. The portion of the blank, at which the central cam 2 intended for engagement with a fuel feed pump is to be formed, is heated to a temperature which is the highest, e.g., a temperature in the range of 600° C.—1200° C. in the case of steel. For instance, if the portion, at which the central cam 2 is to be formed, is heated to a temperature of 1,000° C., the portions of the blank at the opposite sides of the central cam-forming portion, at which the cams 3, 5 are to be formed, are heated to a temperature lower than the heating temperature for the portion of the blank where the cam 2 is to be formed, e.g., about 900° C. The portions of the blank outwardly adjacent to the cams 3, 5, at which the cams 4, 6 are to be formed, are heated to a temperature lower than the heating temperature for the portions where the cams 3, 5 are to be formed, e.g., about 800° C.

The blank is heated usually for 30 seconds to 4 minutes up to predetermined heating temperatures starting from the room temperature.

Figure 6:
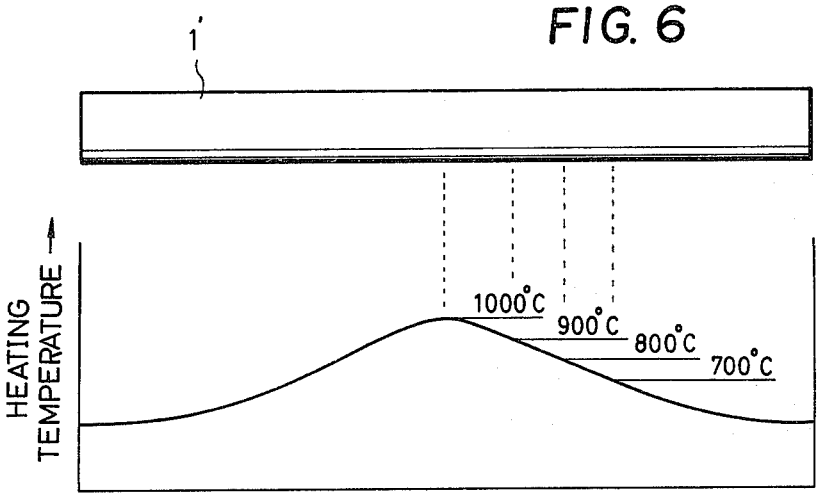
FIG. 6 is a graph showing the heating temperature distribution of a camshaft blank according to the method of the invention.

In the above description of the heating step of a camshaft blank, the specific values of the heating temperatures are given. However, it should be understood that what is important lies in heating the blank in accordance with such a heating temperature distribution curve as shown in FIG. 6. More specifically, the portion of the blank 1' at which the central cam is to be formed should be heated to a predetermined temperature which is the highest, the portions of the blank at the opposite adjacent sides of the central cam-forming portion where the outer cams are to be formed should be heated to a temperature lower than the above-mentioned central temperature, and the outer or end portions outwardly adjacent the above-mentioned outer cam-forming portions, where additional outer cams are to be formed, are heated to lower temperatures.

Due to this heating manner, the blank can have different deformation resistances over the length thereof. That is, the blank has a lowest deformation resistance at the central portion with its deformation resistance gradually increasing toward the ends to thereby determine the sequence of formation of cams along the cam-forming portion of the blank.

Figure 5:
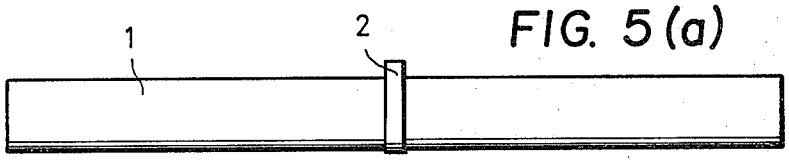
FIGS. 5(*a*)–5(*c*) are views showing the formation sequence of cams on a camshaft blank.
Figure 5:
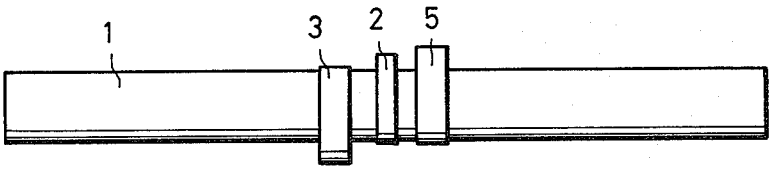
Figure 5:
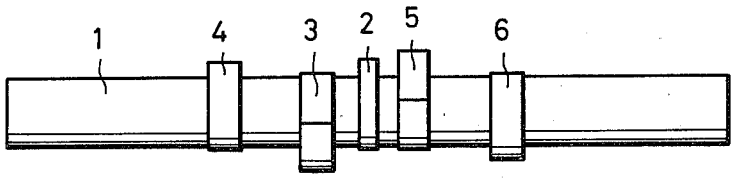

A hot steel blank in the form of a wire or a bar which has thus been heated is positioned into the die 7 of the forging machine shown in FIG. 4. The upper hydraulic cylinder 20 is then actuated to hold the die 7 closed by piston 19 and die holders 17, 18, while simultaneously the hydraulic cylinders 13, 14 located at the opposite ends of the die 7 are also actuated to cause the punches 9, 10 to apply 100 tons–200 tons of pressure to the opposite ends of the hot blank in the die 7 in the axial directions. During this pressure application, central cam 2 adapted for engagement in a fuel feed pump is first formed as shown in FIG. 5(*a*), followed by formation of cams 3, 5 as shown in FIG. 5(*b*). Lastly, cams 4, 6 are formed as shown in FIG. 5(*c*) with the cams 2, 3, 5 simultaneously having their peripheries definitely shaped. Then, the blank is further pressed to have the peripheries of the cams 4, 6 definitely shaped as well.

Then, the blank thus formed with the cams has its surfaces quenched under conventional conditions and ground into accurate finishing sizes.

In the above-given embodiment, Steel Bar S48C and S45C according to Japanese Industrial Standard (JIS) G 3102 can be used as preferable materials for the camshaft. These bars have the following compositions:

| | Chemical Composition | |
|---|---|---|
| | S48C | S45C |
| C: | 0.45–0.51% | 0.42–0.48% |
| Si: | 0.15–0.35% | 0.42–0.48% |
| Mn: | 0.60–0.90% | 0.42–0.48% |
| P: | 0.030% or less | 0.42–0.48% |
| S: | 0.035% or less | 0.42–0.48% |
| Fe and Inevitable Impurities: | the balance | 0.42–0.48% |

The inevitable impurities consist of 0.30% or less Cu, 0.20% or less Ni and 0.20% or less Cr, the total of Ni and Cr not exceeding 0.35%.

As a material for the blank may also be used Steel Bar SCM21H (chromium-molybdenum steel) according to JIS G 4051 which has a chemical composition of 0.12–0.18% C, b 0.15–0.35% Si, 0.55–0.90% Mn, 0.030% or less P, 0.030% or less S, 0.85–1.25% Cr, 0.15–0.35% Mo and the balance of Fe and inevitable impurites, the inevitable impurities including 0.25% or less Ni.

Since the above-cited steels are rather soft, have low deformation resistance and may suffer less deoxidation and less decarbonization, they are particularly suitable for use as blanks for forging by the method of the invention.

In the aforedescribed embodiment, the dimensions of the blank before and after forging are shown below:

| | Before Forging | After Forging |
|---|---|---|
| Length: | 300mm | 236mm |
| Diameter: | 22.5mm | 23mm |

Figure 7:
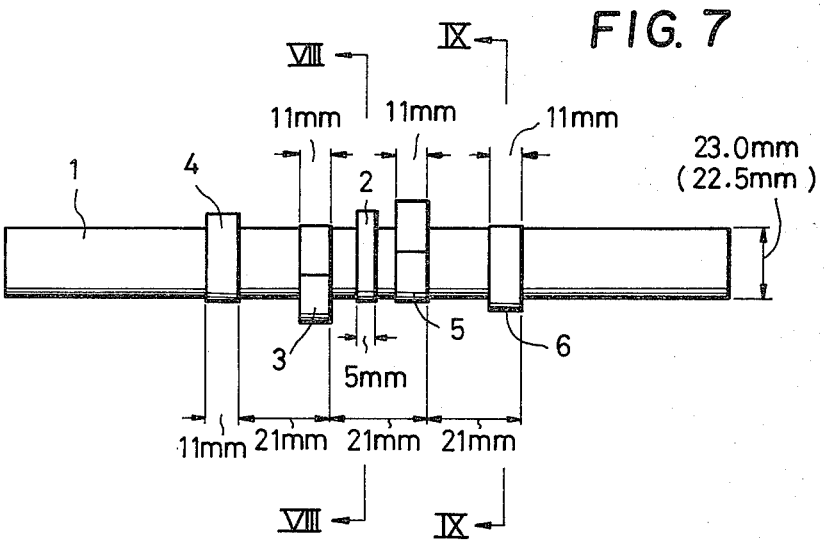
FIG. 7 is a front view of a camshaft obtained by the method of the invention.
Figure 8:
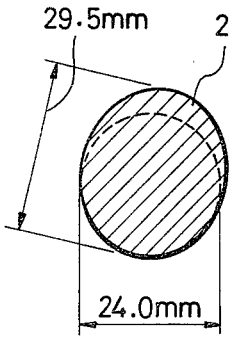
FIG. 8 is a sectional view taken on line VIII—VIII of FIG. 7.
Figure 9:
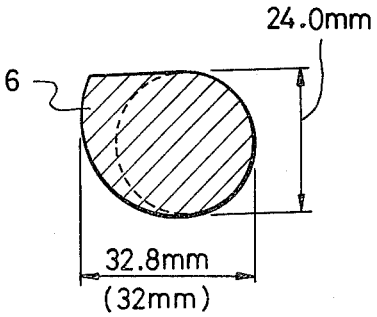
FIG. 9 is a sectional view taken on line IX—IX of FIG. 7.

The camshaft obtained by the forging method of the aforedescribed embodiment has a configuration and a size as shown in FIGS. 7, 8 and 9. The parenthesized figures represent sizes after finish grinding.

Figure 10A:
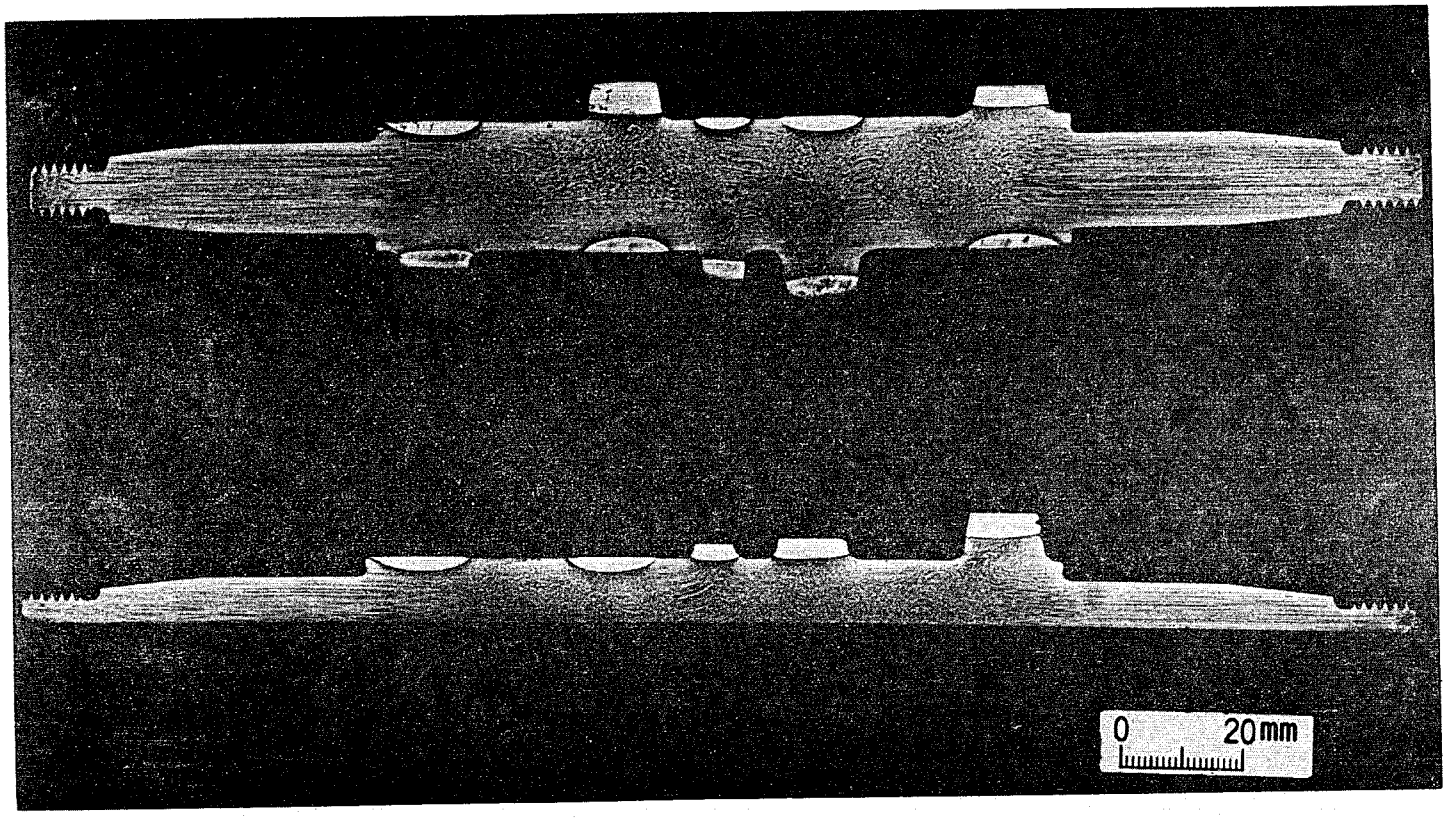
FIGS. 10(*a*) and 10(*b*) are photographs showing in section a camshaft obtained by the method of the invention.
Figure 10:
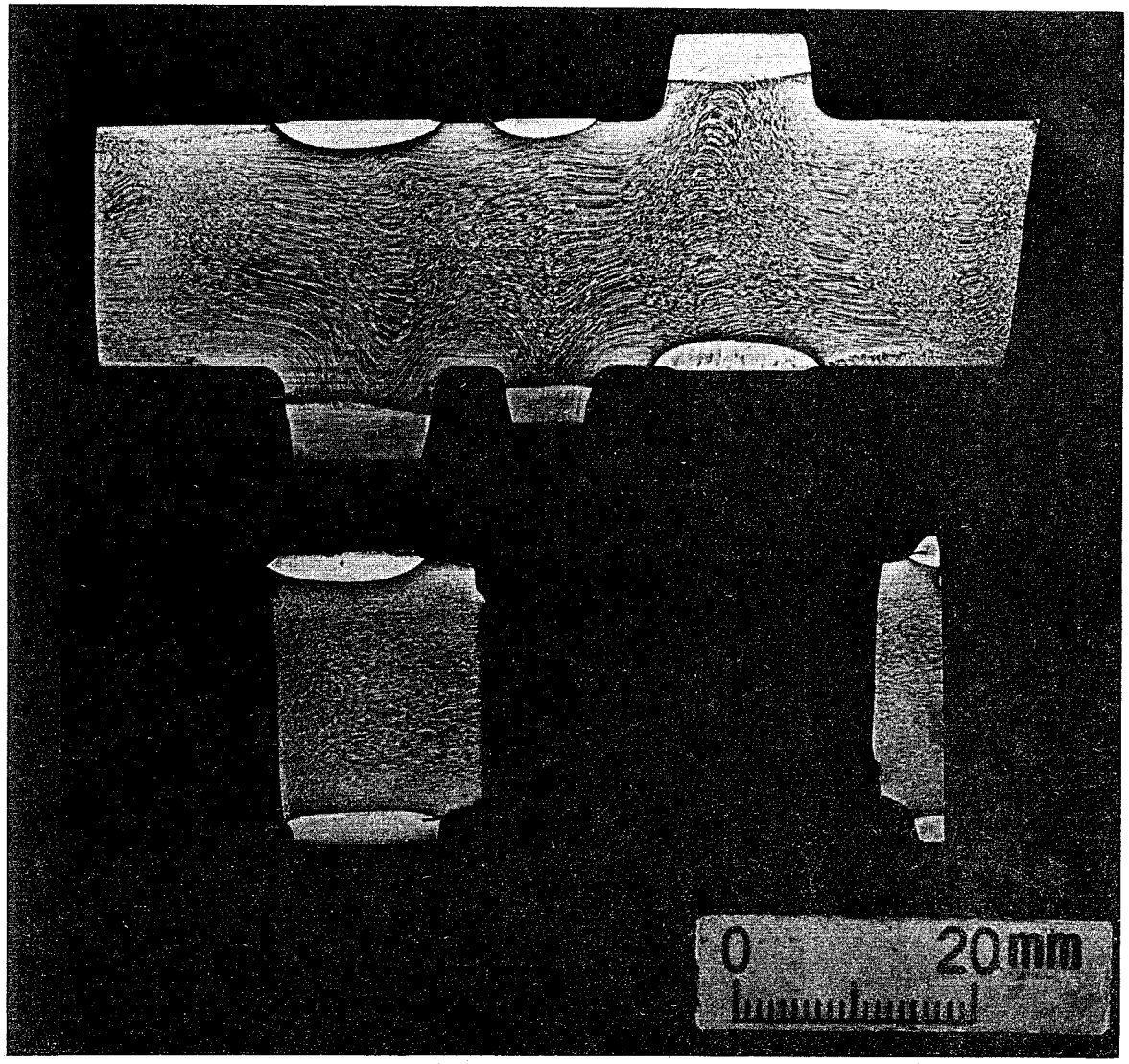

A camshaft thus obtained by the forging method according to the invention can have a forged fibre flow extending therein with no substantial breaks as shown in FIG. 10 (*a*) and (*b*) (photographs), and can therefore have a sufficiently high mechanical strength.

Incidentally, the heating temperatures for the camshaft blank according to the invention are not limited to the values stated in the foregoing. In accordance with this invention, so far as the heating temperatures are within a range of temperatures at which forging operations are possible, the lower the heating temperatures, the more effective the forging method is, since the blank suffers less decarbonization and less oxidation if it is heated to such lower temperatures. Further, since the camshaft produced by the method of the invention has been subjected to heating before pressing in the dies, after pressing it need not be subjected to annealing or normalization for removal of residual stress.

It is to be understood that the foregoing description relates to a preferred embodiment of the invention and that various changes and modifications may be made in the invention without departing from the spirit and scope thereof.

What is claimed is:

1. A method of manufacturing by forging a camshaft having a plurality of plane cams, said plane cams being enlarged radially outwardly, and integrally formed on an outer peripheral surface of said camshaft in a longitudinal arrangement, the method comprising:

(a) heating an elongated blank of a metal or an alloy to a plurality of different temperatures, wherein the blank has a cam-forming portion thereof heated to said different temperatures in a manner gradually decreasing in heating temperature from an axially central position thereof towards opposite ends thereof;

(b) then positioning a substantially whole portion of the blank thus heated into a forging die; and (c) axially applying pressure to said heated blank at opposite ends thereof in the forging die to cause the same to be axially compressed, such that said cam-forming portion is radially outwardly deformed only by said axial pressure application and cams are formed on the cam-forming portion of the outer peripheral surface of the blank in sequence, starting first with the axially central position of the cam-forming portion towards the opposite ends thereof.

2. The method of claim 1, wherein the blank is made of steel, said heating step (a) comprising heating the axially central position of the cam-forming portion of the blank to a temperature within a range of from 600° C. to 1,200° C.

3. A camshaft manufactured by the method of claim 1 or claim 2.

4. The method of claim 1, wherein said heating step (a) comprises heating said blank in an induction furnace.

5. The method of claim 4, wherein said induction furnace is a high-frequency heater.

6. The method of anyone of claims 1, 2, 4 or 5, wherein said blank has a chemical composition consisting essentially of 0.42–0.51% C, 0.15–0.35% Si, 0.60–0.90% Mn, up to 0.030% P, up to 0.035% S and the balance of Fe and impurities, the impurities including up to 0.30% Cu, up to 0.20% Ni and up to 0.20% Cr, the total of Ni and Cr not exceeding 0.35%.

7. The method of one of claims 1, 2, 4 or 5, wherein said blank has a chemical composition consisting essentially of 0.12–0.18% C, 0.15–0.35% Si, 0.55–0.90% Mn, up to 0.030% P, up to 0.030% S, 0.85–1.25% Cr, 0.15–0.35% Mn and the balance of Fe and impurities, the impurities including up to 0.25% Ni.

8. The method of anyone of claims 1, 2, 4, or 5 wherein said blank is a steel blank.

* * * * *